US009601038B2

(12) United States Patent
Shwed

(10) Patent No.: US 9,601,038 B2
(45) Date of Patent: Mar. 21, 2017

(54) REFLECTIVE DECORATIVE ASSEMBLY

(76) Inventor: Roman Z. Shwed, Margate, FL (US)

( * ) Notice: Subject to any disclaimer, the term of this patent is extended or adjusted under 35 U.S.C. 154(b) by 749 days.

(21) Appl. No.: 12/784,354

(22) Filed: May 20, 2010

(65) Prior Publication Data

US 2011/0287207 A1 Nov. 24, 2011

(51) Int. Cl.

| | |
|---|---|
| ***F21V 21/00*** | (2006.01) |
| ***F21S 4/00*** | (2016.01) |
| ***G09F 13/16*** | (2006.01) |

(52) U.S. Cl.

CPC ..... *G09F 13/165* (2013.01); *Y10T 428/17* (2015.01)

(58) Field of Classification Search

CPC ..... G09F 13/165; Y10T 428/17
USPC ..... 362/249.01–249.14
See application file for complete search history.

(56) References Cited

U.S. PATENT DOCUMENTS

| | | | | | |
|---|---|---|---|---|---|
| 30,822 | A | * | 12/1860 | Kato | 241/273 |
| 175,017 | A | | 3/1876 | Blowney | |
| RE24,368 | E | | 10/1957 | Touche | |
| 2,912,778 | A | | 11/1959 | Battaglia | |
| 2,938,291 | A | | 5/1960 | Tavan | |
| 2,969,606 | A | | 1/1961 | Battaglia | |
| 3,026,608 | A | | 3/1962 | Holcombe | |
| 3,140,553 | A | * | 7/1964 | Taylor | 40/426 |
| 3,166,863 | A | | 1/1965 | Gray | |
| 3,189,183 | A | | 6/1965 | Thrasher | |
| 3,202,288 | A | * | 8/1965 | Thrasher | 211/13.1 |
| 3,206,882 | A | | 9/1965 | Thatcher | |
| 3,260,372 | A | | 7/1966 | Jauslin | |
| 3,298,123 | A | | 1/1967 | Ownbey | |
| 3,365,824 | A | * | 1/1968 | Winrow | G09F 9/375 40/449 |
| 4,015,255 | A | * | 3/1977 | Wood | G04C 19/04 340/815.62 |
| 4,017,992 | A | | 4/1977 | Kajitani | |
| RE30,822 | E | | 12/1981 | Kato | |
| 4,308,680 | A | | 1/1982 | Aboudi | |
| 4,671,916 | A | * | 6/1987 | Hamas | 264/249 |
| 6,278,431 | B1 | * | 8/2001 | Kao | 345/111 |
| 8,066,405 | B2 | * | 11/2011 | Simon | 362/249.01 |

OTHER PUBLICATIONS

See attached International Search Report dated Aug. 19, 2011.

* cited by examiner

*Primary Examiner* — Andrew Coughlin
*Assistant Examiner* — Jessica M Apenteng
(74) *Attorney, Agent, or Firm* — J. Todd Rushton

(57) ABSTRACT

The present invention is an assembly and method for providing a reflective decoration assembly that includes a frame having a pair of opposing frame edges and a plurality of first frame supports, where each frame support is arranged in a plane with at least two other first frame supports, is arranged in a plane defined by the pair of opposing frame edges, has a portion between the pair of opposing frame edges, and is substantially parallel to at least one other first frame support. The reflective decoration assembly also features a plurality of second frame supports, each being arranged in an intersecting configuration with at least two of the first frame supports. Disc attachment posts have a first end attached to the frame and a second end separated from the first end, the second end having a disc retaining head thereat.

19 Claims, 16 Drawing Sheets

100

400

800

1200

1500

REFLECTIVE DECORATIVE ASSEMBLY

FIELD OF THE INVENTION

The present invention relates generally to a reflective decoration and more particularly relates to a reflective decorative assembly that includes pivotable disks and can be used to form signage or other decorative elements.

BACKGROUND OF THE INVENTION

Signs and other decorative elements enjoy myriad applications. One type of sign that has particular visual impact utilizes an array of reflective disks supported on a corresponding array of disk support posts. Each disk is prevented from being removed from the post while, simultaneously, being allowed a degree of movement relative to the post to which it is attached. Typically, the disks are coated with a reflective material and, when viewed from a distance, the array of moving disks provides the appearance of a shimmering surface. In addition, the color of each disk can be selected so that, when viewed from a distance, the array of disks spells out words, forms patterns, or creates images.

In most installations, the array of disks is installed one at a time by pressing a pin or small nail through a preformed aperture in a disk and then inserting the nail into a supporting surface. This method of installing the disks provides for a great deal of customization of each sign or decorative surface but is clearly very time consuming due to the large number of disks needed in a typical application. In addition, when installing each disk and post individually, it is difficult to ensure uniform spacing between each disk.

Some installations of reflective discs are facilitated by a sheet with an array of disc attachment posts available for placement and support of discs. However, the sheet is solid, which limits the movement of the discs, the visual appeal of the sign, as well as the ability to customize the shape and size of the sign during installation. Other installations are facilitated by frames that support a single row of discs. However, uniformity between rows is difficult to achieve during installation and preloaded images on the single-row frames is difficult to assemble in the field.

After placement of the disk arrays on supporting structure, one way to improve the shimmering effect of the disks is to provide a light source that directs light onto the disk surfaces. Generally, this is accomplished with one or more light sources that are spaced away, i.e., separate, from the disks and are aimed at the visible surface of the disks. Unfortunately, when an object or person comes between the light source and the disks, the light source is prevented from reaching the disks. For instance, if the application is a background at a red carpet event, where the background runs parallel to the path of the carpet, persons walking the red carpet may have to walk between the light source and the support structure.

Therefore, a need exists to overcome the problems with the prior art as discussed above.

SUMMARY OF THE INVENTION

The invention provides a reflective decoration assembly that overcomes the hereinafore-mentioned disadvantages of the heretofore-known devices and methods of this general type.

With the foregoing and other objects in view, there is provided, in accordance with the invention, a reflective decoration assembly that includes a frame having a pair of opposing frame edges and a plurality of first frame supports, where each frame support is arranged in a plane with at least two other first frame supports, is arranged in a plane defined by the pair of opposing frame edges, has a portion between the pair of opposing frame edges, and is substantially parallel to at least one other first frame support. The reflective decoration assembly also features a plurality of second frame supports, each being arranged in an intersecting configuration with at least two of the first frame supports, thereby defining a plurality of frame voids. A plurality of disc attachment posts have a first end attached to the frame and a second end separated from the first end by a predefined distance, the second end having a disc retaining head thereat. A plurality of discs have a surface defining a hole therein and, when installed on the disc attachment posts, the hole surrounds a portion of the length of one of the disc attachment posts and has at least one dimension smaller than a corresponding dimension of the head.

In accordance with another feature, an embodiment of the present invention includes a light emitter, such as an LED or light pipe, at least one of the disc retaining heads.

In accordance with a further feature of the present invention, the first end of each disc attachment post is attached to the frame substantially at an intersection of one of the first frame supports and one of the second frame supports.

In accordance with a further feature of the present invention, the at least one dimension of the disc is a largest dimension of the hole.

In accordance with another feature, an embodiment of the present invention includes lines of weakness along at least one of the plurality of first frame supports and the plurality of second frame supports, the lines of weakness proving instant frame sizing locations.

In accordance with the present invention, a method for providing a frame that includes a pair of opposing frame edges and a plurality of first frame supports, where each frame support is arranged in a plane with at least two other first frame supports, arranged in a plane defined by the pair of opposing frame edges, has a portion between the pair of opposing frame edges, and is substantially parallel to at least one other first frame support. The frame includes a plurality of second frame supports, where each is arranged in an intersecting configuration with at least two of the first frame supports, thereby defining a plurality of frame voids and a plurality of disc attachment posts each having a first end attached to the frame and a second end separated from the first end by a predefined distance. The method also includes providing a plurality of discs, each one of the plurality of discs having a surface defining a hole therein, placing the hole in one of the discs over one of the disc attachment posts, and deforming a plurality of second ends of the disc attachment posts in a single step to form a disc retaining head having at least one dimension larger than a corresponding dimension of the hole in the disc.

In accordance with another feature of the present invention the deforming step includes melting the second ends of the disc attachment posts and can also include defining a convex shape at the second ends of the disc attachment posts.

In accordance with a further feature of the present invention a reflective coating is provided on a surface of the convex shape.

In accordance with yet another feature, an embodiment of the present invention forms a light emitter in at least one of the disc attachment posts.

In accordance with a further feature of the present invention, at least two unique light paths are formed from locations on the frame to at least two of the disc attachment posts.

Although the invention is illustrated and described herein as embodied in a reflective decoration assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of a support member of the decorative frame.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
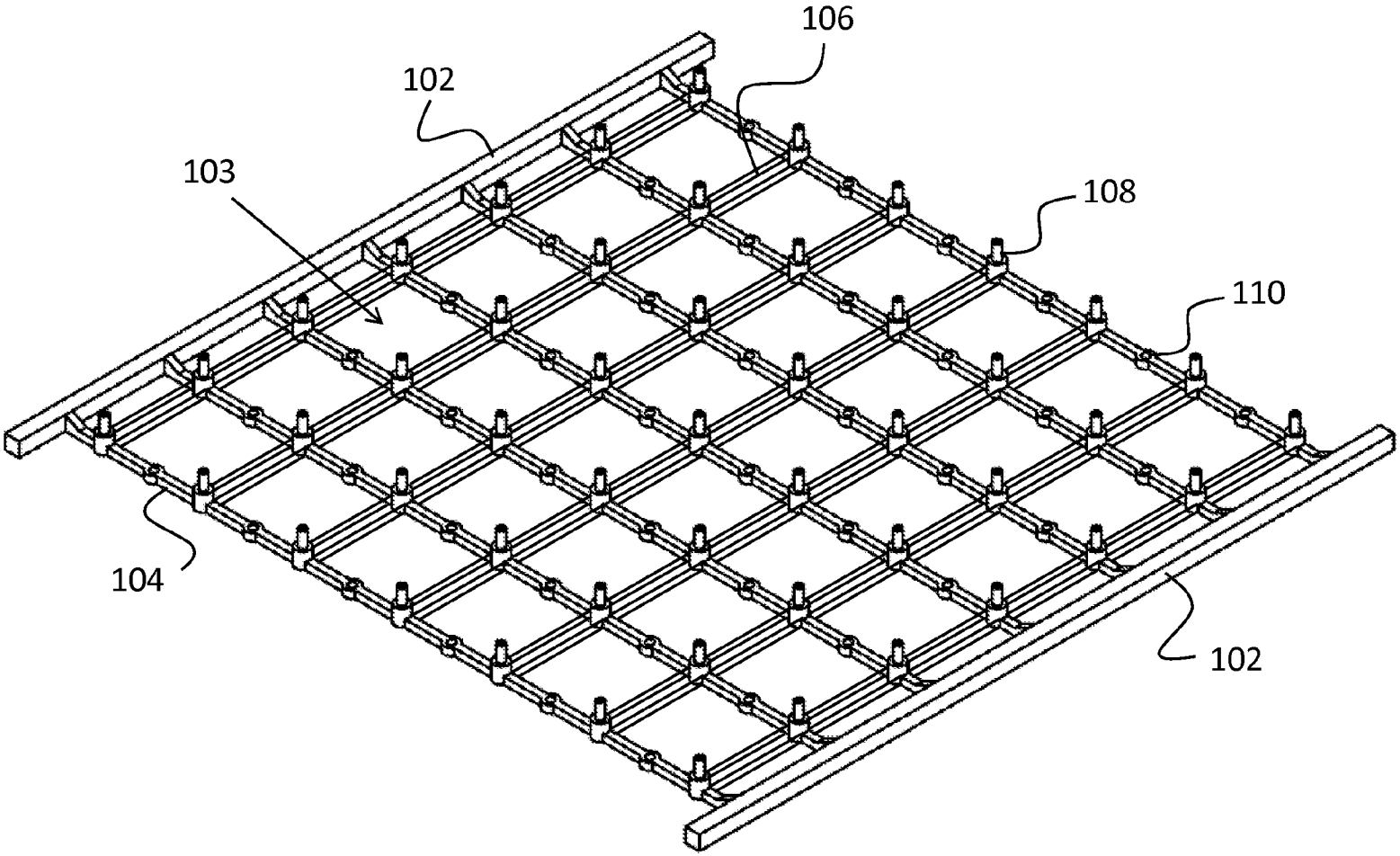
FIG. 1 is a perspective view of a decorative frame structure in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient reflective decoration assembly. Embodiments of the invention provide improved disc securing and installing structures. In addition, embodiments of the invention provide improved visually stimulating signage.

Referring now to FIG. 1, one embodiment of the present invention is shown in a perspective view. The figure shows several advantageous features of the present invention, but, as will be described below, is in no way narrowing, as the invention can be provided in several shapes, sizes, combinations of features and components, and varying numbers and functions of the components. A first component of an inventive reflective decoration assembly, as shown in FIG. 1, is a frame 100 that, in a later step, provides support for a plurality of discs 200 (not show in this view) which ultimately reside on the reflective decoration assembly. The frame 100 includes a first pair of frame edges 102 which oppose one another. In the embodiment shown, the frame edges 102 are substantially parallel to one another. However, the frame edges 102 can take on various configurations which include both parallel and non-parallel, depending on the nature of the decorative assembly.

The frame edges 102 of the assembly are connected through a plurality of frame supports 104. In one embodiment, the frame supports 104 are positioned within a plane defined by the frame edges 102 and are parallel with each other. There is no requirement, however, for any particular number of frame supports or that any two are parallel with each other. As can be seen in FIG. 1, it is the frame edges 102 and frame supports 104 that form the basic structure of the frame 100. Although at least two frame supports 104 are preferred and, as is shown in FIG. 1, additional frame supports 104 can be included as well. Naturally, structural support increases in correspondence with the number of structural supports 104 present.

In addition, secondary frame supports 106 can be provided, which span in directions that vary from the longitudinal direction of the first frame supports 104. In one embodiment, shown in FIG. 1, the secondary frame supports 106 intersect the first frame supports 104 and are substantially parallel to the opposing frame edges 102. The first frame supports 104 and secondary frame supports 106 define a plurality of frame voids 103. This perpendicular/parallel alignment, however, is merely exemplary and is not required. The secondary frame supports 106 provide additional bracing for the frame 100. Since the size of an assembly can differ based on the project, secondary frame supports 106 improve the overall stability of the frame 100 and, of course, the entire reflective decoration assembly once it is together. In addition, the number of frame supports 104 and secondary frame supports 106 included on the frame 100 can vary based upon the complexity and size of the reflective decoration assembly. Because the frame is envisioned as having longitudinal members, such as the opposing frame edges 102, first frame supports 104, and second frame supports 106, as shown in FIG. 1, one can easily and quickly remove portions of the frame/assembly to customize the frame's shape for a particular application merely with a pair of cutters. Removing sections of the frame 100 will not be substantially detrimental to the overall rigidity of the frame 100.

The frame 100, according to one embodiment, also includes disc attachment posts 108 protruding from the frame supports 104. In some cases, although not necessary, the disc attachment posts 108 are at an intersection between the first frame supports 104 and the secondary frame supports 106. The disc attachment posts 108 have a first end that is attached to the frame 100 on either a frame support 104 or at the intersection of a frame support 104 and a secondary frame support 106. The disc attachment posts 108 then extend outward away from the frame 100 for a prescribed length.

Figure 2:
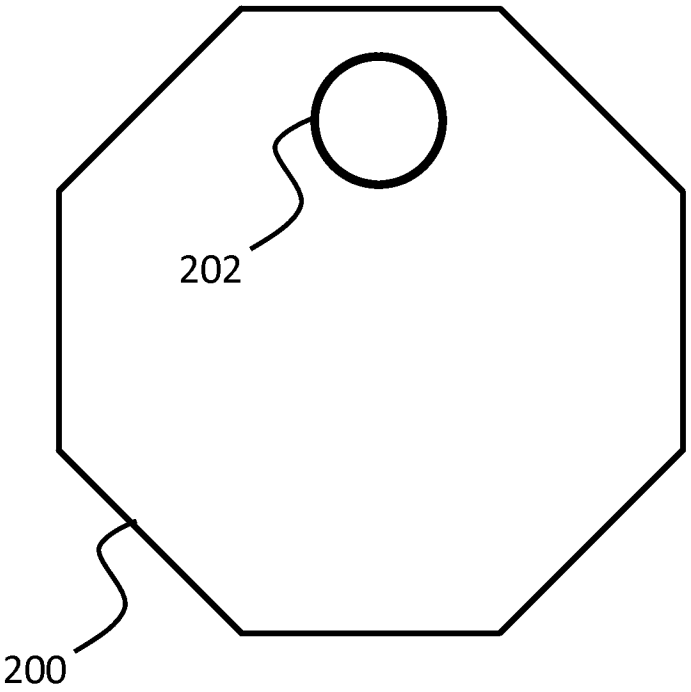
FIG. 2 is an elevational view of a decorative disc in accordance with the present invention.

The present invention also includes for a plurality of discs 200, as shown in FIG. 2. The discs 200 can have myriad shapes or profiles and are in no way limited to the octagonal shape depicted in FIG. 2. Additionally, the discs 200 may be planar or have a three dimensional profile, such as a curve, depending on the desired effect of the reflective decoration assembly. Each of the discs 200 contains a disc hole 202. The hole 202 can be circular as shown in FIG. 2 but is not limited to one particular shape or profile.

Each disc 200 is placed onto the disc attachment post 108 through the disc hole 202. The diameter of the disc hole 202 is larger than the diameter of the disc attachment post 108. This difference in size allows the disc 200 to move with a degree of freedom once it is placed on the disc attachment post 108. Once the discs 200 are place on the disc attachment posts 108, a disc retaining head 300, as shown in the profile view of FIG. 3, is formed.

Figure 3:
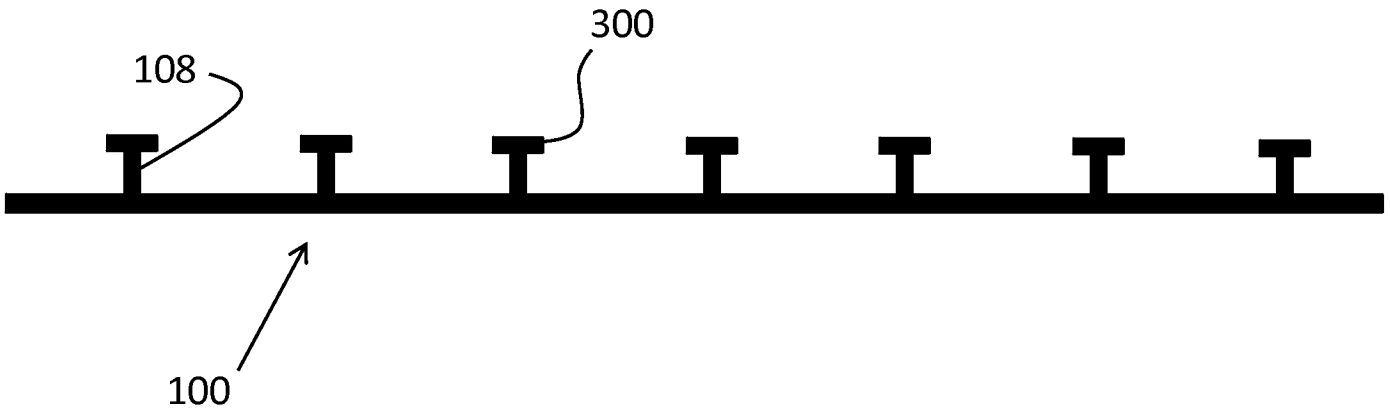
FIG. 3 is an elevational edge view of a decorative frame structure with deformed disc retaining heads in accordance with the present invention.
Figure 5:
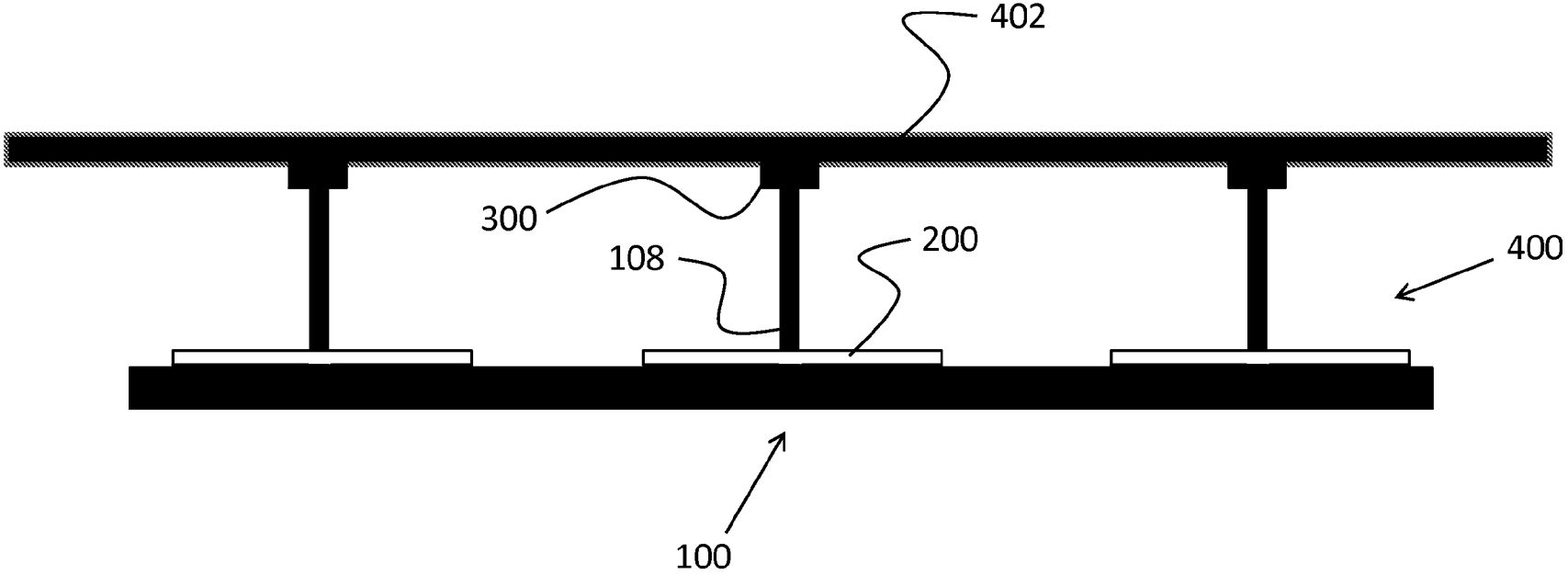
FIG. 5 is an elevational edge view of the decorative frame structure of FIG. 4 with the deformation plate making contact with and deforming the disc retaining heads of the decorative frame structure in accordance with the present invention.
Figure 6:
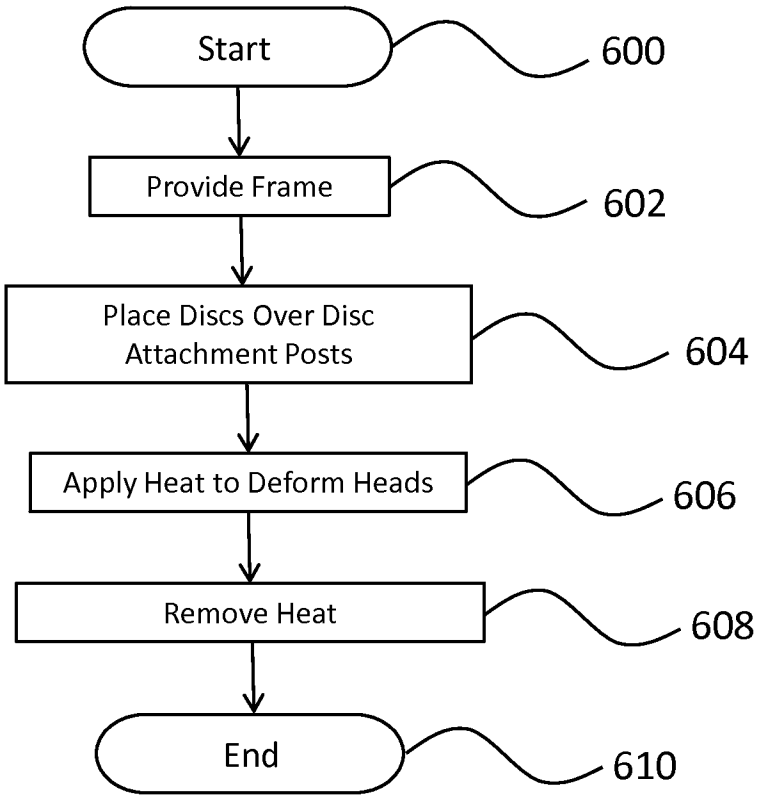
FIG. 6 is a process flow diagram of a method of manufacturing the decorative frame assembly in accordance with an exemplary embodiment of the present invention.

In accordance with one embodiment of the present invention, the heads 300 are formed through use of a heating element, e.g. a hot plate, that presses down on and melts the upper end of the disc attachment posts 108 to form the disc retaining heads 300 and create the shape shown in FIG. 3. This process is illustrated in FIGS. 4 and 5 and shown in the flow chart of FIG. 6.

Figure 4:
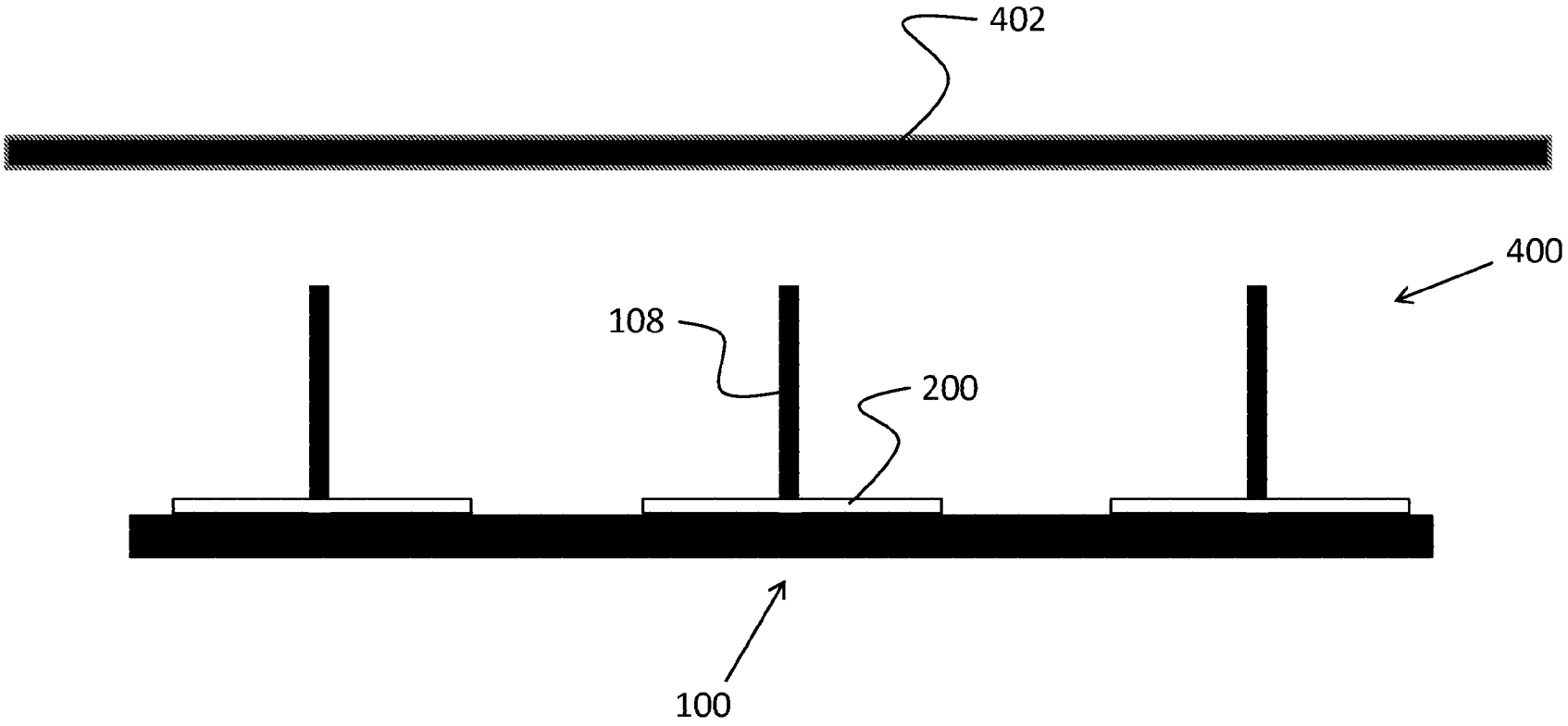
FIG. 4 an elevational edge view of a decorative frame structure with decorative discs placed over non-deformed disc retaining heads and a deformation plate adjacent the decorative frame structure in accordance with the present invention.

FIG. 4 shows an elevational side view of an inventive assembly 400 in accordance with the present invention. The disc assembly 400 includes the frame 100 with disc attachment posts 108 pointed in an upward position. Once the frame 100 is available, the discs 200 are inserted over the disc attachment post 108 so that the hole 202 (not visible in this side view of FIG. 4) of each disc 200 is placed over a disc attachment posts 108. These first two steps are shown in the process flow diagram of FIG. 6 and are indicated as steps 602 and 604. Looking back at FIG. 4, in this side view, it can be seen that the discs 200 could easily be removed by slipping them back off (an upward direction in this view) of the disc attachment post 108. In other words, there is no structure on the disc attachment posts 108 that would prevent the discs from being removed.

Figure 7:
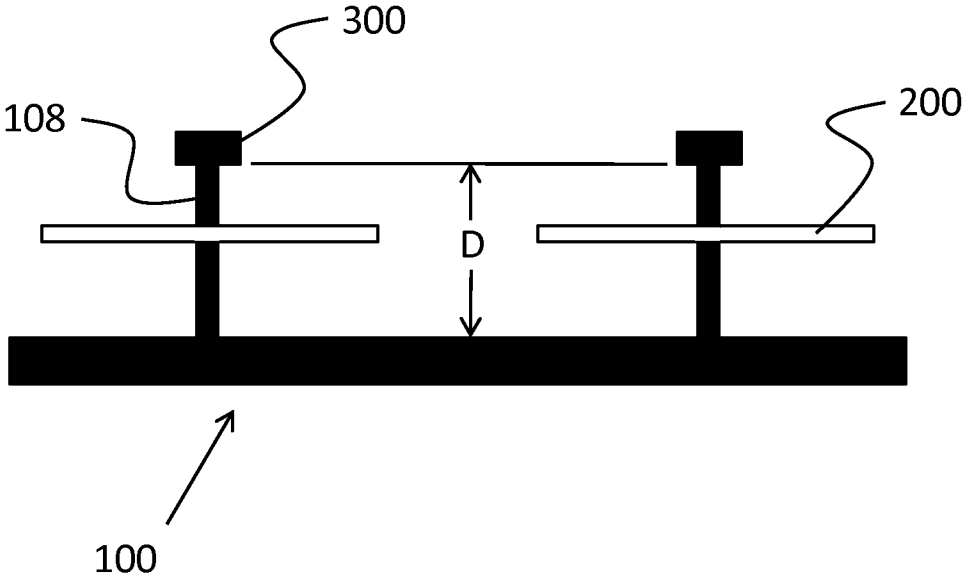
FIG. 7 is an elevational edge view of another exemplary embodiment of the decorative frame structure of FIG. 5 in accordance with the present invention.

Also shown in FIG. 4 is a hot plate 402 positioned above the disc assembly 400. In a further step, 606 in FIG. 6, the frame 100 and, in particular, the upper portions of the disc attachment posts 108, are brought into contact with the hot plate 402. This is shown in FIG. 5. Due to the heat supplied by the hot plate 402, the disc attachment posts 108, which, in one embodiment, are made of butyrate or a shore A polycarbonate, but can be any deformable material, deform in a way that expands its non-deformed dimensions to create disc retaining heads 300. After melting or deforming has occurred, in step 608, the hot plate 402 is removed, providing a completed assembly 400, a portion of which is shown in FIG. 7. It is noted that, although a hot plate and heating method have been described, other manufacturing processes can also be used to create the disc retaining heads 300 without departing from the spirit of the present invention.

Preferably, as can be seen in FIG. 7, the diameter of the disc retaining heads 300 is greater than at least one dimension of the disc holes 202 after the melting step 606 is completed. Although the term "diameter" is referenced herein, disc attachment post 108, the head 300, and the disc holes 202 are not limited to circular shapes. "Diameter" may also refer to the largest width of a shape or dimension of any element of the present invention. For instance, the disc hole 202 is not required to be round in shape and can be ovular, square, or any other shape. Generally, as long as at least one dimension of the hole 202 is less than a corresponding dimension of the head 300, the disc retaining head 300 will prevent or impede the disc 200 from being removed from the disc attachment posts 108. It is envisioned, however, that the discs 200 will be of a pliable material so that even after the disc retaining heads 300 are formed, the discs 200 can be removed from the disc attachment posts 108 by simply applying the proper amount of force and deforming the discs 200.

FIG. 7 provides an elevational top-down view of a portion of the reflective disc assembly 400 with discs 200 positioned on the disc attachment posts 108 with the end of the post flared into a head 300 to keep the discs 200 from being removed from the posts 108. Notably, each post 108 has a length that defines a distance "D" between the main plane of the frame 100 and head 300. Because the thickness "T" of each disc 200 is less than the distance "D," the discs 200 are able to move on the post 108 when, for instance, air is blown upon them. When the discs 200 are provided with a reflective finish, the result is a type of a shimmer. In common use, the discs 200 will be numerous and when placed upon an assembly 400, the result is akin to seeing water reflecting light.

Referring back to FIG. 1, it can be seen that the frame 100 is provided with a plurality of mounting holes 110. The mounting holes provide a location where a screw, nail, a hook, or other attachment mechanism can be used to secure the frame 100 and entire disc assembly 400 to a structure. A decorative disc assembly with a frame 100 provides many benefits over the prior art method of individually nailing each disc to a surface. By utilizing a frame 100, the discs are reliably maintained at a uniform distance from one another. In addition, the frames can be assembled at a remote location and then easily installed on site with much less attention to detail required. For instance, in some applications, many colors of discs 200 are used to create a complex image. This detail may be beyond the abilities of a worker hired to assemble the signs. The assembly location also may be difficult to access, such as a tall billboard, and tedious selecting and mounting of discs would be difficult or impossible. Furthermore, pre-building frame assemblies 400 allows for, as described above, a simple process for securing the discs 200 to the frame 100.

In addition, because the frame 100 is formed from a matrix of members 102, 104, 106, complete customization is possible by merely severing the frame with, for instance, a pair of cutters, to remove sections of the assembly 400. Furthermore, as will be described below, the present invention can be provided with convenient structures for snapping adjacent frames together for quick installation and full control of spacing between discs.

Figure 8:
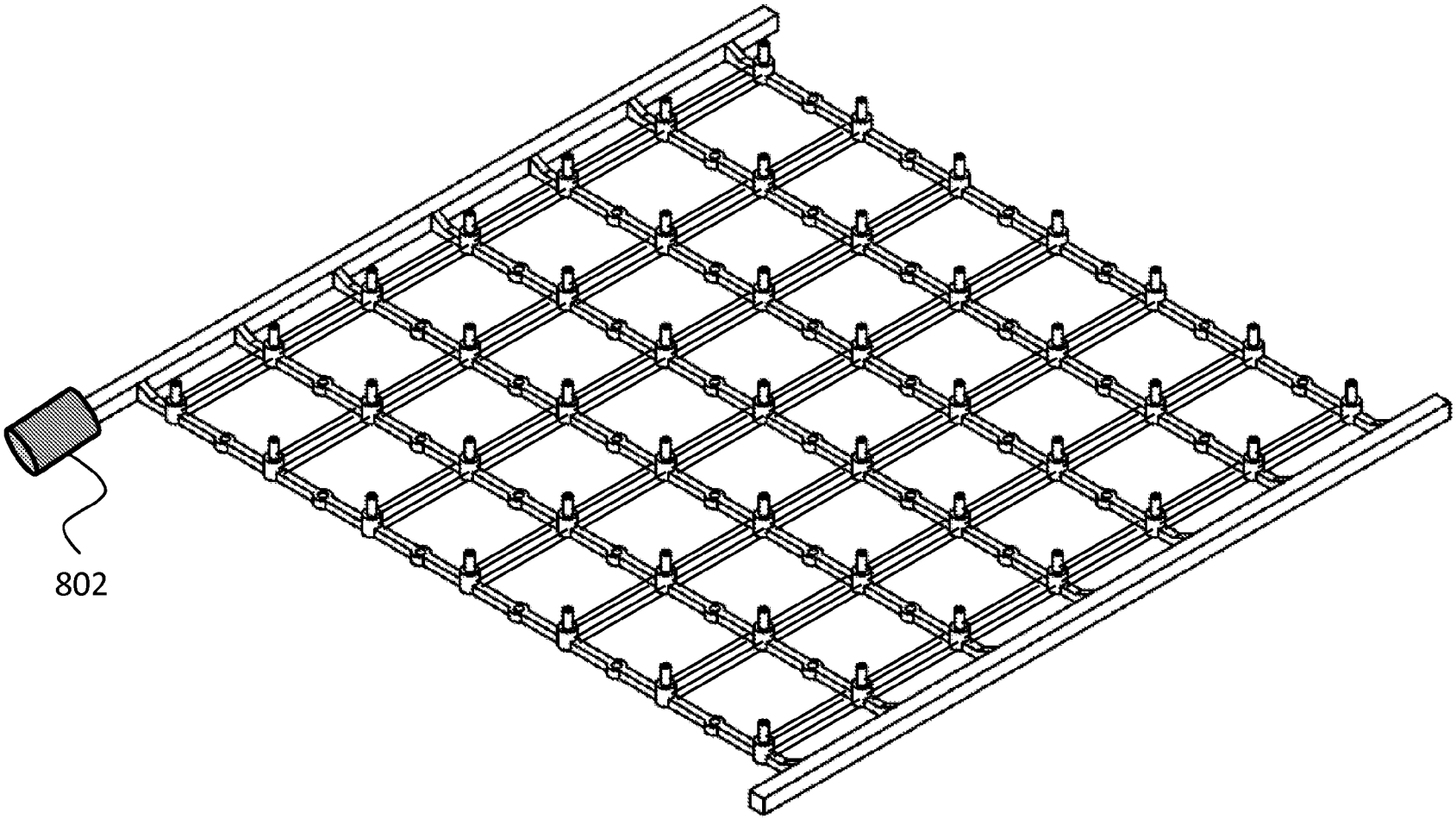
FIG. 8 is an elevational view of a further exemplary embodiment of a decorative frame structure having a light source attached thereto in accordance with the present invention.

In a further embodiment of the present invention, a light source is provided within or in contact with the frame 100. As one example, FIG. 8 shows a frame 800 with a light source 802 coupled to the frame 800. The light source 802 can be, for instance, a light emitting diode (LED), a laser, a light bulb, or any other device that can introduce light into the frame 800. In this embodiment, the frame 800 is of a material that conducts light. Light communication via optical conductors, commonly referred to as "fiber optics," is well known in the art. In the embodiment shown in FIG. 8, light generated or communicated by light source 802 travels through the frame 800. Well known techniques of polishing and curving the frame elements can optimize light transmission and steering capabilities. When the light is emitted from the frame 800, an improved appearance is achieved. For instance, the entire frame could be made to illuminate, so that the entire structure could be seen from a distance. Alternatively, the light could be made to emit only from a particular portion(s) of the frame 800. For example, using current fiber optic steering and polishing techniques, the light could be emitted only from or near the head 300 of each of the posts 108.

Figure 9:
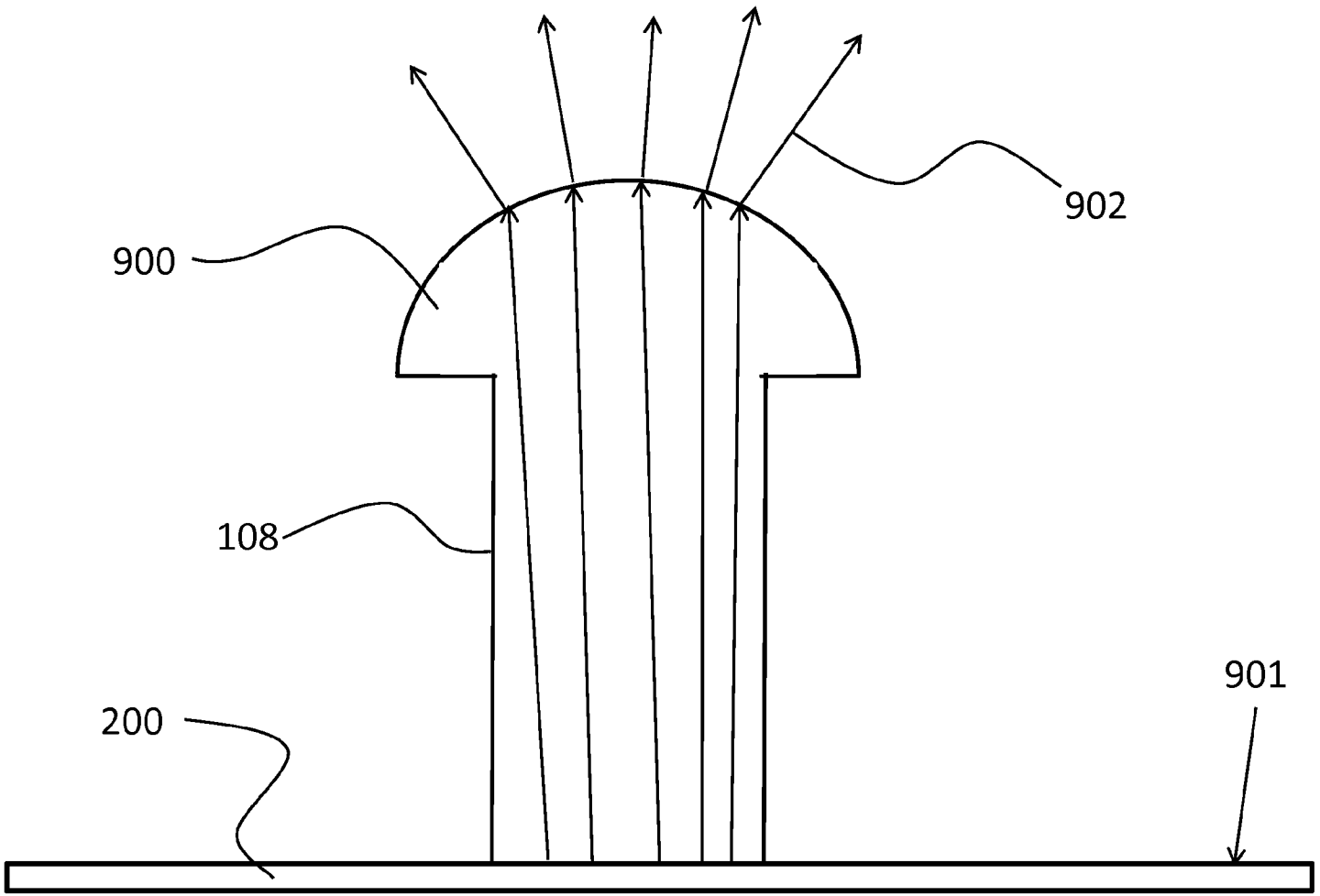
FIG. 9 is an elevational view of an exemplary embodiment of a light-emitting disc retaining head in accordance with the present invention.

FIG. 9 shows one particular embodiment of a head 900 that emits light, thus, vastly improving the overall visual affect of the assembly. In this embodiment, although it is not necessary, the head 900 is curved. Curvature can easily be accomplished by, for instance, utilizing a hot plate 402 with curved indentations. When light 902 is piped through the frame 800, it is ultimately emitted from the head 900, which is located between a surface 901 of the disc 200 and the viewer.

Figure 10:
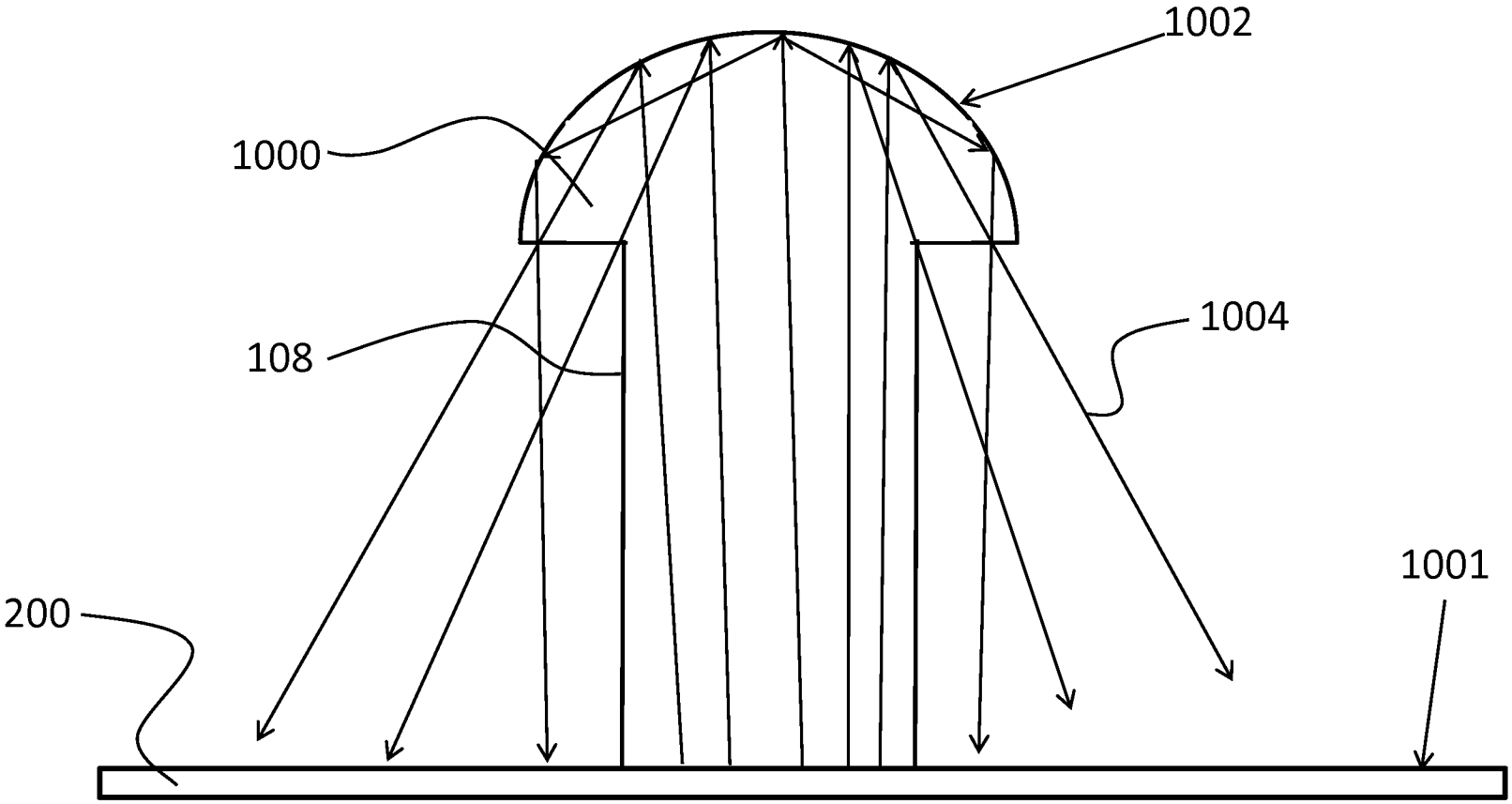
FIG. 10 is an elevational view of an exemplary embodiment of a light-reflecting disc retaining head in accordance with the present invention.

In another embodiment, shown in FIG. 10, the head 1000 reflects light back onto the visible surface 1001 of a disc 200, thus, vastly improving the overall visual affect of the assembly. In this embodiment, the curved surface 1002 of the curved head 1000 is provided with a reflective coating, i.e., has a mirrored interior surface, which causes light 1004 to be directed to the surface 1001 of the disc 200.

As a way of ensuring that light is only able to escape from selected areas of the frame 800, the frame can be painted or coated with, for instance, black paint. In this embodiment, if, for instance, the frame is of a clear plastic-type material, only the exposed, i.e., unpainted, areas would emit light.

Figure 11:
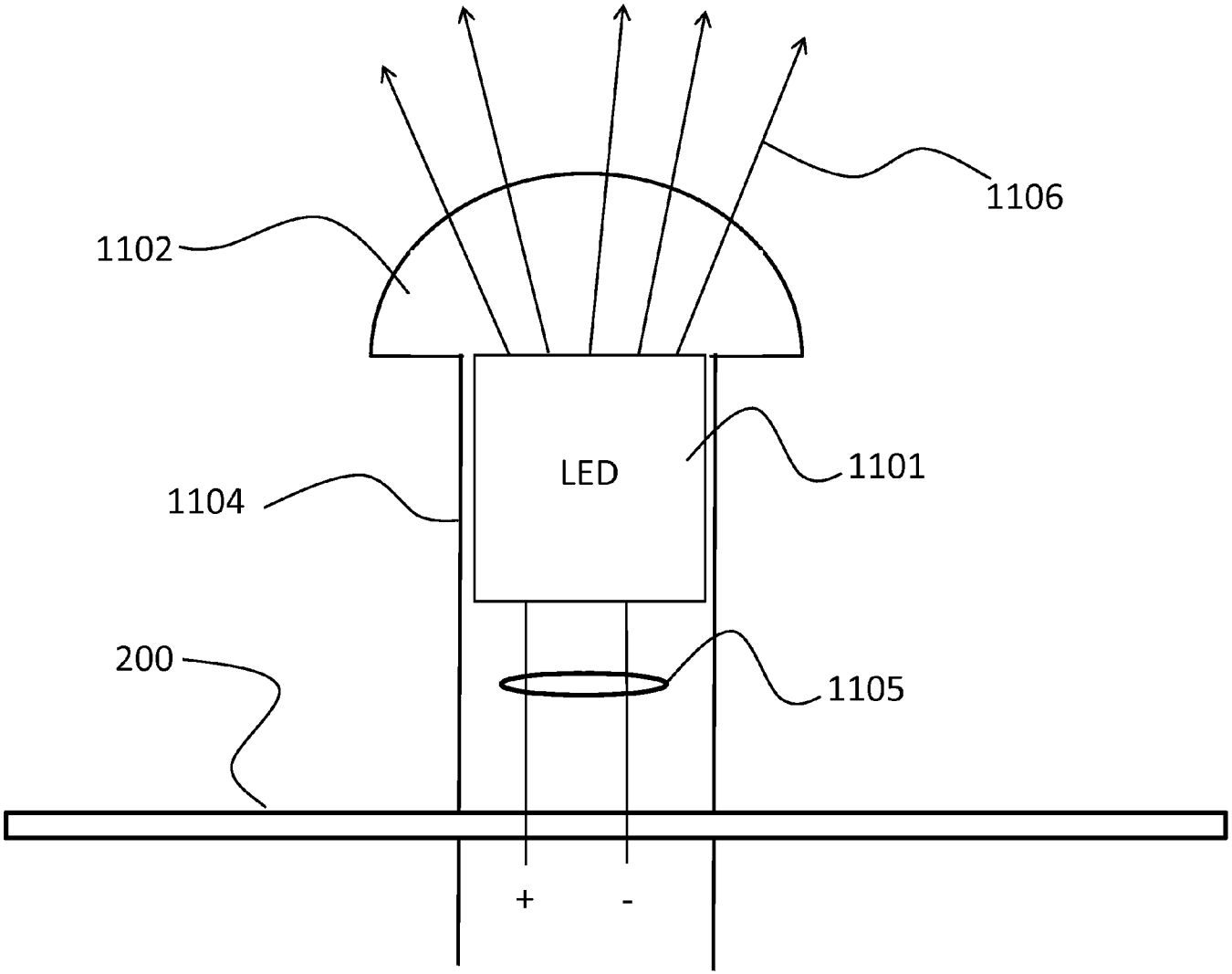
FIG. 11 is an elevational view of an exemplary embodiment of a light-producing disc retaining head in accordance with the present invention.

In yet another embodiment of the present invention, a light source is provided on one or more disc attachment posts 108. For example, as shown in FIG. 11, an LED 1101 is at the head 1102 of a disc attachment post 1104. The LED 1101 is powered by electrical leads 1105 and emits light 1106 when energized. In this embodiment, a plurality of posts 1104 can be provide with LEDs 1101, which can provide multiple colors and alternate on and off times to spell out messages or create visually stimulating patterns. In addition, the LED 1101 does not need to be near the head 1102 of the post 1104. The LED 1101 can be positioned lower in the post 1104 or can be within the frame 800. In addition, if the LED 1101 is place within a structure similar to that of FIG. 10, with reflective coating on a surface of the head 300, light can be directed back onto the face of the disc 200 for improved light effects.

Figure 12:
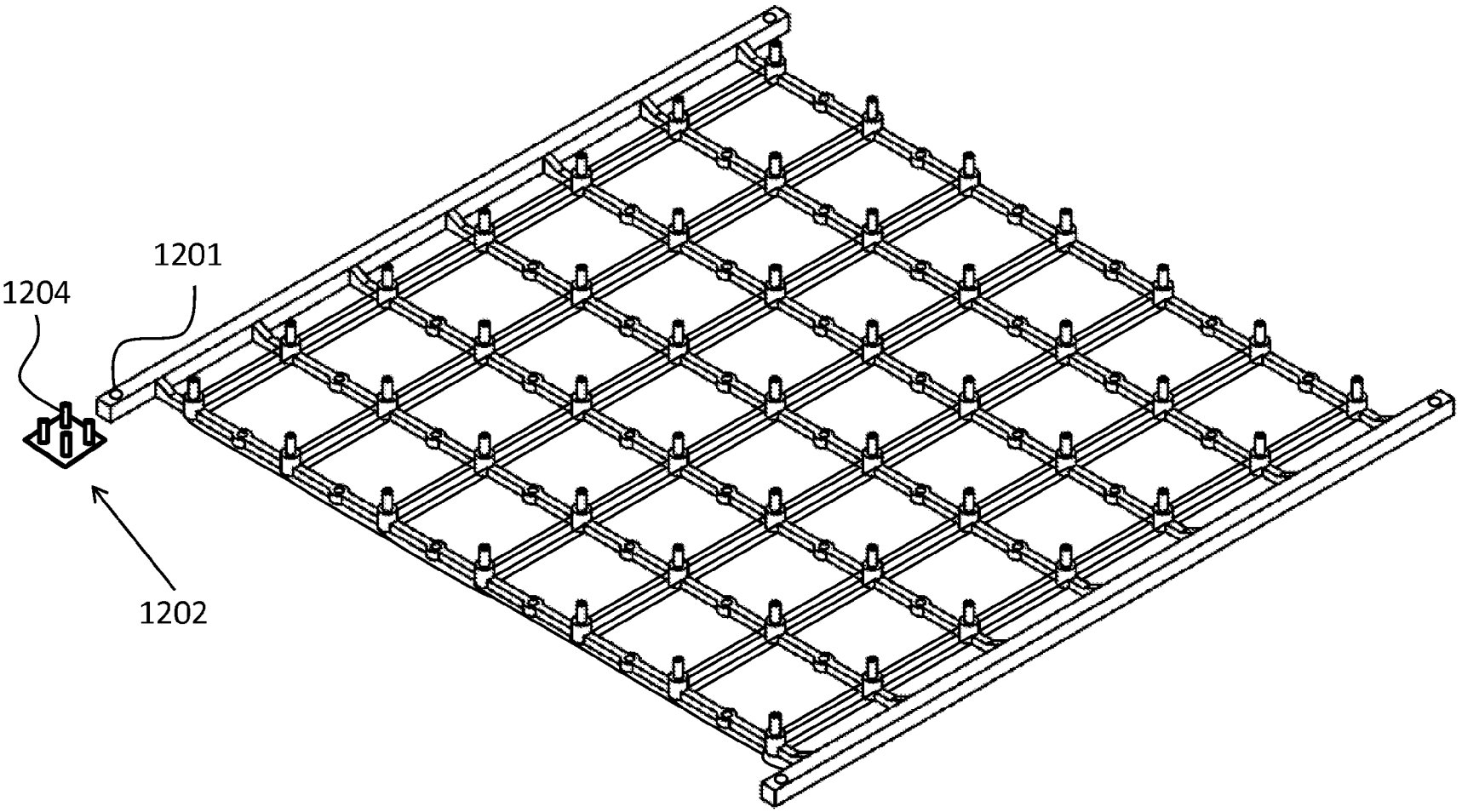
FIG. 12 is a perspective view of an exemplary embodiment of a frame with a locking member in accordance with the present invention.

Embodiments of the present invention provide further advantages as the frames 100 have features that allow them to be easily and securely attached to each other at the time of mounting. In addition, embodiments of the inventive frames are provided with features that allow extensions of light paths and/or electrical connections. More specifically, FIG. 12 shows exemplary edges of an inventive frame 1200 with linking features. Frame 1200 is provided with voids 1201 that are indentations in the frame material. A linker 1202 can be used to couple up to four frames together. An exemplary application would be the creation of a "curtain" of frames 1200, where a single frame 1200 is secured to a ceiling or other structure and one or more additional frames are attached to and supported by the first frame. As can be seen in FIG. 12, the linker 1202 is provided with members 1204 that extend therefrom. In this embodiment, the members 1204 are shaped and sized to be inserted within the voids 1201 and provide securing contact between the frame 1200 and the linker 1202.

Figures 16, 17:
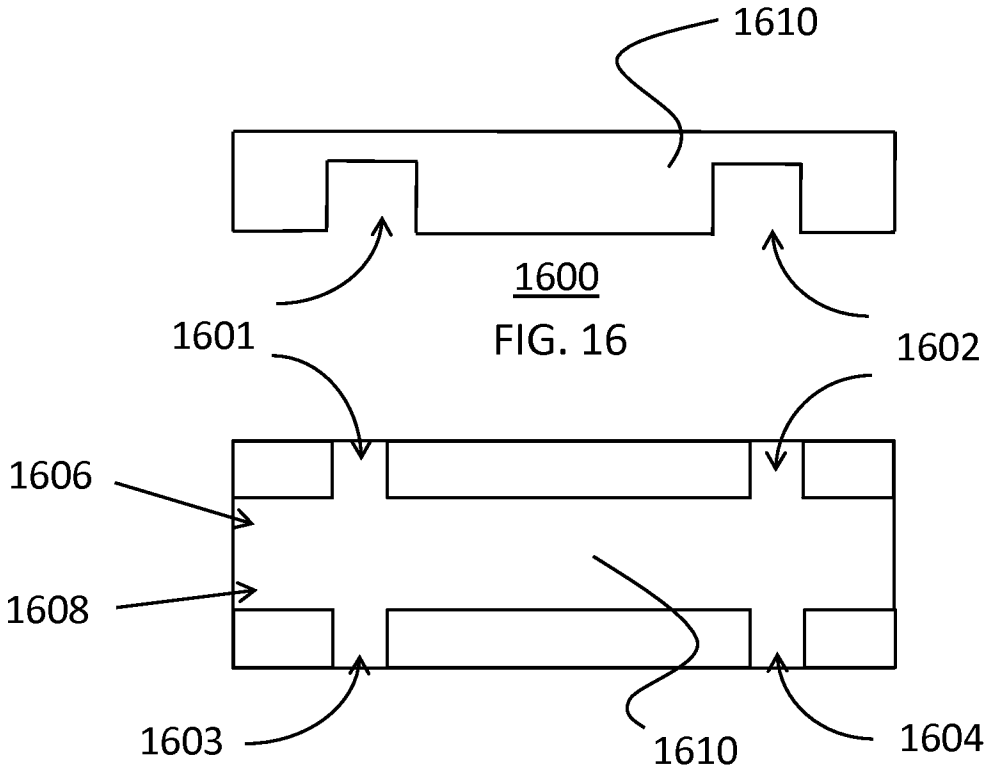
FIG. 16 is an elevational edge view of a linking block in accordance with embodiments of the present invention.
FIG. 17 is an elevational bottom view of the linking block of FIG. 16 in accordance with embodiments of the present invention.

Additional linking embodiments are also contemplated by the present invention. For instance, turning briefly to FIGS. 16 and 17, a linking block 1600 is shown. The linking block 1600 is sized and shaped to couple two frames to one another by insertion of frame portions into channels within the block 1600. More specifically, block 1600 has a body 1610 with four short channels, 1601, 1602, 1603, and 1604. The short channels 1601, 1602, 1603, and 1604 are sized to fit over and securely couple to frame edges 102 and/or frame supports 104. The block 1600 also has two long channels 1606 and 1608 that are also sized to fit over and securely couple to frame edges 102 and/or frame supports 104. The blocks 1600 can be used to couple multiple frames together as the only linking and supporting structure or to simply add further structural support to frames that are attached to a surface.

In addition, the frame itself can be formed with locking shapes at ends of frame edges 102. The frames can then be attached to each other without the need for additional hardware because the locking shape of one frame is complimentary with the locking shape of a second frame.

Figure 13:
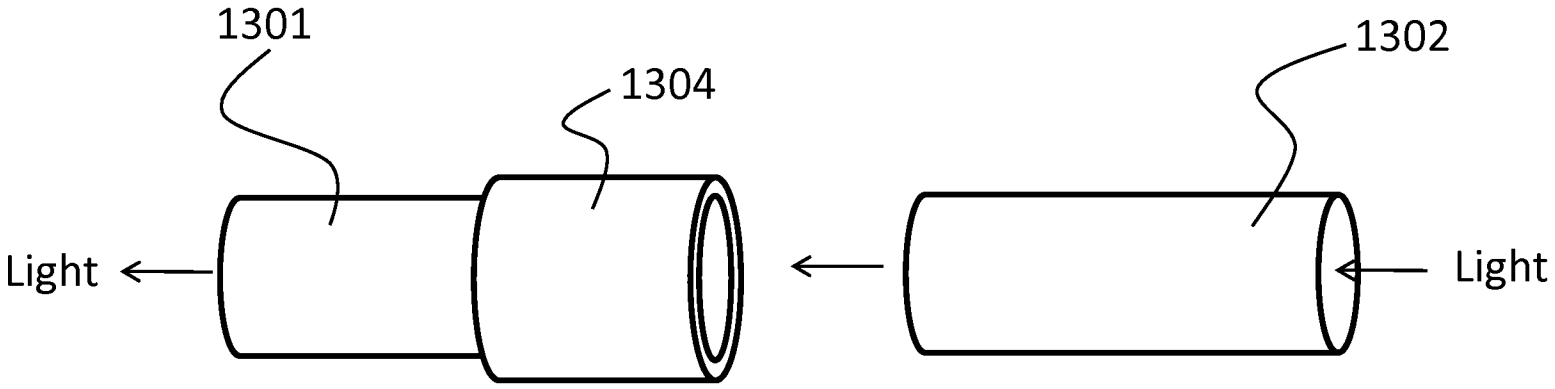
FIG. 13 is an perspective view of light transmission couple between two adjacent decorative frame structures in accordance with the present invention.

Returning back to FIG. 13, a coupling configuration is shown where an end of a first frame support 1301 (which could alternatively be a frame edge) from a first frame and an end of a second frame support 1302 are able to join so that light exiting the first frame support 1301 enters the second frame support 1302. More specifically, in this particular embodiment, the first frame support 1301 is provided with a coupling sleeve 1304 that securely receives the end of the second frame support 1302. The configuration shown, of course, is merely one example of how to couple two light communicating structures. Other examples are male/female connectors, interlocking members, multifaceted coupling members, and many others.

Figure 14:
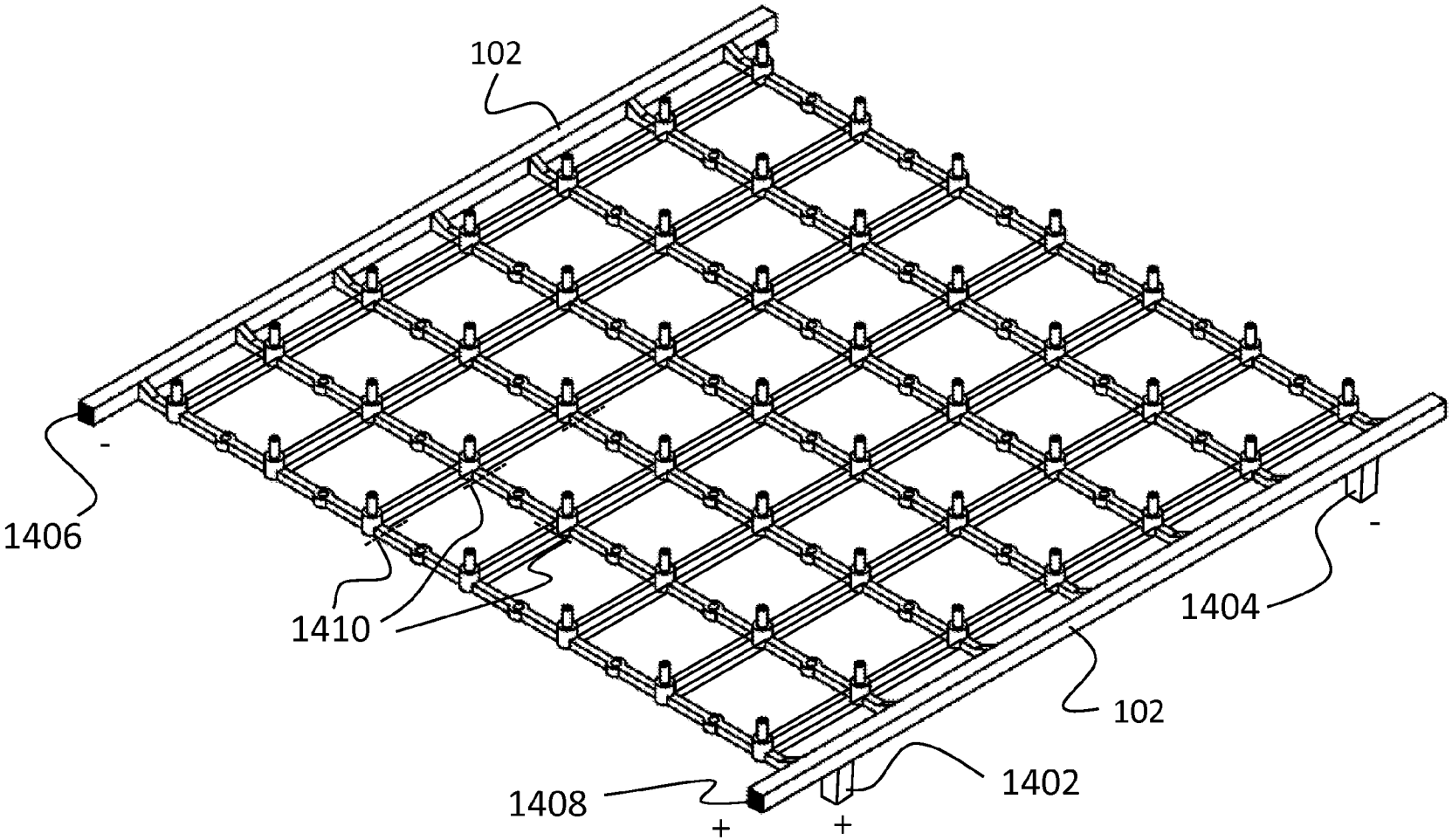
FIG. 14 is a perspective view of the decorative frame structure of FIG. 1 with electrical contacts and lines of weakness in accordance with embodiments of the present invention.

In addition, referring briefly back to FIG. 11, if LEDs 1101 are used within the inventive frame, the LED power leads 1105 can be powered through external contacts at specific locations on the frame. For Example, FIG. 14 shows a frame 1400 with first 1402 and second 1404 contacts on the back side thereof. The contacts 1402 and 1404 allow the frame 1400 to be easily energized simply by coupling it to a powered substrate. As one example, a wall could be covered with a powered mounting board that features a plurality of female ports that are shaped to accept the male contacts 1402 and 1404. The powered mounting board not only allows a fast and easy mounting procedure, but also allows the frames 1400 to all share a common power source.

In accordance with another embodiment of the present invention, the frames 1400 can have external leads that electrically couple to one another so that power can be communicated from one frame to the other by simply snapping or otherwise physically coupling them together. A second set of exemplary leads 1406 and 1408 are also show in FIG. 14 at ends of the frame edges 102. If an adjacent frame has similar contacts, electricity can be transferred from one frame to the other simply by bringing the frames into contact with one another. Of course, the contacts 1402, 1404, 1406, and 1408 are merely exemplary and the invention is in no way limited to those shown or described.

In addition, the frame portions can be provided with what is referred to herein as "lines of weakness." "Lines of weakness" refers to locations along the frame that, when pressure is applied to the frame, are the most likely places to bend or snap apart. The lines of weakness can be formed by scoring the surface of the frame elements, forming them with less material than other locations, injecting air during the frame forming operation, or many other ways. FIG. 14 shows several representative lines of weakness 1410. By utilizing the lines of weakness 1410, an installer can easily and quickly remove sections of the frame without tools for the purpose of proving the appropriate shape or design.

Figure 15:
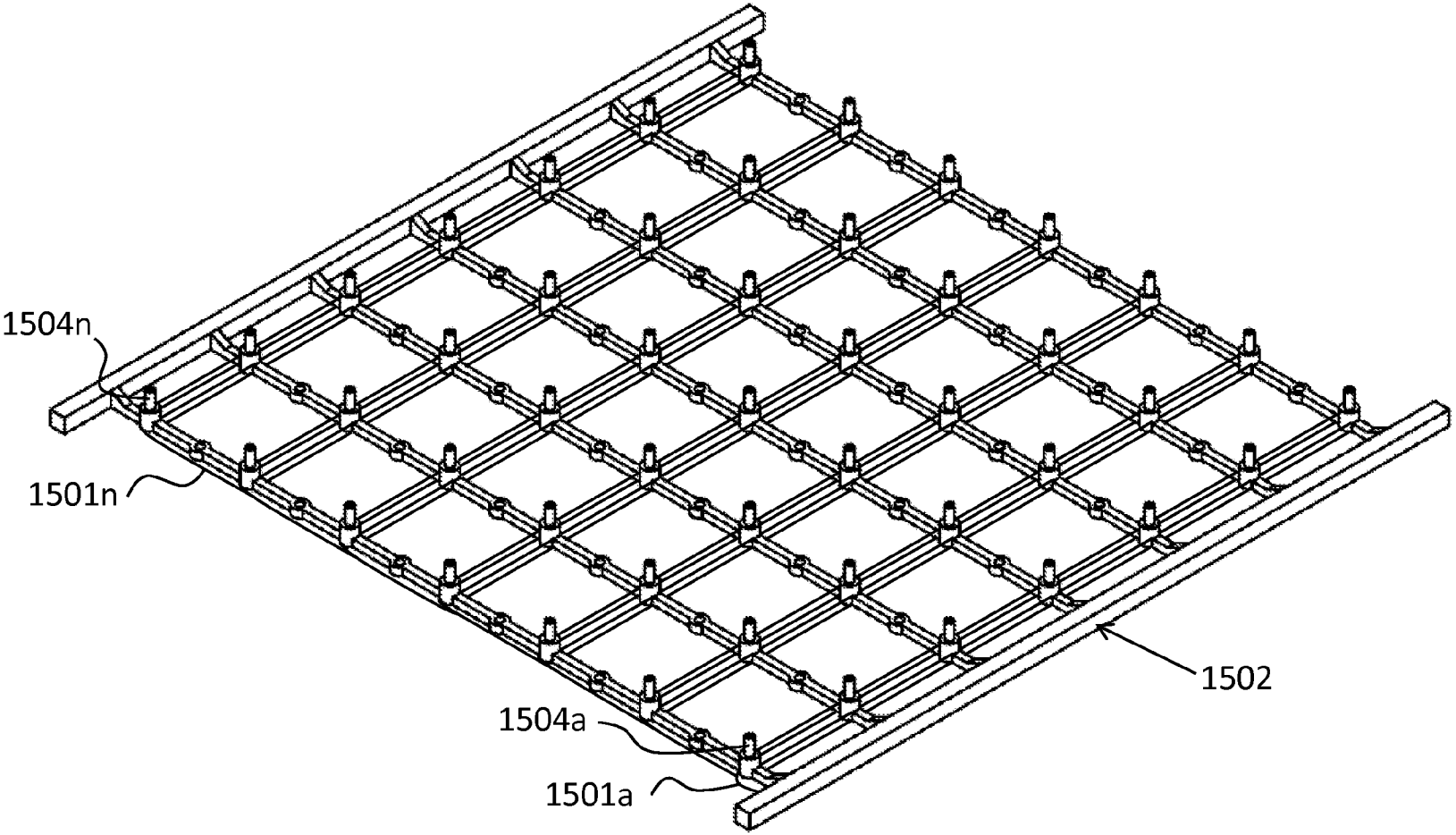
FIG. 15 is a perspective view of the decorative frame structure of FIG. 1 with individual light paths in accordance with embodiments of the present invention.

Furthermore, in one embodiment, as shown in FIG. 15, the present invention provides one or more unique light paths 1501*a*-1501*n* spanning from locations on the frame 1502 to at least two respective ones of the disc attachment posts 1504*a*-1504*n*. The light paths 1501*a*-1501*n* can be fiber optics pathways that communicate light produced by a light source and deliver it to the respective disc attachment posts 1504*a*-1504*n*. The unique light paths 1501*a*-1501*n* can be built into the frame or can be separate optical pathways attached to the frame 1502 and/or energizable at a location(s) along the frame 1502.

In a preferred embodiment, the panels are molded from Butyrate or a Shore A Polycarbonate. Since the reflective decoration assembly 400 can be utilized in numerous locations, it is preferable if the assembly 400 is of materials that are able to withstand normal temperature gradients. In addition, the reflective decoration assembly 400 can include portions that are UV light resistant, thereby prolonging the useful life of the device.

In an additional embodiment of the present invention, at least one or more of the discs 200 are photocells, which collect energy from light. Photocells are well known in the art. The photocell discs can be attached to an energy storage device, such as, for instance, a battery or capacitor, through electrical contacts or leads on or within the frame. In this embodiment, when the photocell discs 200 are exposed to sunlight, such as all during the daylight hours, they can steadily charge the energy storage device. At night, which can be detected, for instance, by a common photocell, the energy storage device can become an energy delivery device that supplies power to, for instance, the LED 1101 shown in FIG. 11. The result is a self sustaining light emitting sign assembly. Low energy consuming LED devices can be used and are available on pressure sensitive tape available from, for instance, the Moda Lighting Company in Las Vegas, Nev.

I claim:

1. A reflective decoration assembly comprising:

a frame including:

a pair of opposing frame edges defining a first plane;

a plurality of first frame supports, each:

arranged in the first plane with at least two other first frame supports;

arranged in the first plane defined by the pair of opposing frame edges;

having a portion between the pair of opposing frame edges; and substantially parallel to at least one other first frame support;

a plurality of second frame supports each arranged in the first plane in an intersecting configuration with at least two of the first frame supports thereby defining a plurality of frame voids, each void bordered by at least two of the second frame supports; and a plurality of disc attachment posts each having a first end attached to the frame and a second end:

separated from the first end by a predefined distance projecting in a direction away from the first plane and defining a second plane parallel with the first plane; and having a disc retaining head formed by melting the second end of the attachment post; and a plurality of discs, each one of the plurality of discs having a surface substantially within the second plane, and the surface defining a hole therein, the hole extending perpendicular to the second plane and the hole surrounding a portion of the length of one of the disc attachment posts and having at least one dimension smaller than a corresponding dimension of the head.

2. The assembly according to claim 1, wherein:

the first end of each disc attachment post is attached to the frame substantially at an intersection of one of the first frame supports and one of the second frame supports.

3. The assembly according to claim 1, wherein the at least one dimension of the disc is a largest dimension of the hole.

4. The assembly according to claim 1, further comprising: a light emitter at least one of the disc retaining heads.

5. The assembly according to claim 4, wherein the light emitter comprises: a light emitting diode.

6. The assembly according to claim 4, wherein the light emitter comprises: a light pipe.

7. The assembly according to claim 4, wherein the disc retaining head comprises:

a reflective coating.

8. The assembly according to claim 1, wherein:

each one of the plurality of discs has a thickness that is less than the length of the post of which it surrounds.

9. The assembly according to claim 1, further comprising:

a first locking shape at a first edge of the frame and a second locking shape at a second edge of the frame.

10. The assembly according to claim 9, wherein:

the first and second locking shapes are complimentary to each other.

11. The assembly according to claim 1, wherein the frame further comprises:

lines of weakness along at least one of the plurality of first frame supports and the plurality of second frame supports, the lines of weakness proving instant frame sizing locations.

12. The assembly according to claim 1, further comprising:

at least two unique light paths spanning from locations on the frame to at least two respective ones of the disc attachment posts.

13. A method of creating a reflective decoration assembly, the method comprising:

providing a frame that includes:

a pair of opposing frame edges defining a first plane;

a plurality of first frame supports, each:

arranged in the first plane with at least two other first frame supports;

arranged in the first plane defined by the pair of opposing frame edges;

having a portion between the pair of opposing frame edges; and substantially parallel to at least one other first frame support;

a plurality of second frame supports each arranged in the first plane in an intersecting configuration with at least two of the first frame supports thereby defining a plurality of frame voids; and a plurality of disc attachment posts each having a first end attached to the frame and a second end projecting away from the first plane and separated from the first end by a predefined distance, the second end defining a second plane parallel with the first plane;

providing a plurality of discs, each one of the plurality of discs having a surface substantially within the second plane, and the surface defining a hole therein;

placing the hole in one of the discs over one of the disc attachment posts; and deforming a plurality of second ends of the disc attachment posts in a single step to form a disc retaining head having at least one dimension larger than a corresponding dimension of the hole in the disc.

14. The method according to claim 13, wherein the deforming includes: melting the second ends of the disc attachment posts.

15. The method according to claim 13, wherein the deforming includes: defining a convex shape at the second ends of the disc attachment posts.

16. The method according to claim 15, further comprising: providing a reflective coating on a surface of the convex shape.

17. The method according to claim 13, further comprising:

forming a light emitter in at least one of the disc attachment posts.

18. The method according to claim 13, further comprising:

forming at least two unique light paths from locations on the frame to at least two of the disc attachment posts.

19. A reflective decoration assembly comprising:

a frame including:

a pair of opposing frame edges;

a plurality of first frame supports, each:

arranged in a plane with at least two other first frame supports; arranged in a plane defined by the pair of opposing frame edges; having a portion between the pair of opposing frame edges; and substantially parallel to at least one other first frame support;

a plurality of second frame supports each arranged in an intersecting configuration with at least two of the first frame supports thereby defining a plurality of frame voids, each void bordered by at least two of the first frame supports; and a plurality of disc attachment posts each having a first end attached to the frame and a second end separated from the first end by a predefined distance projecting in a direction away from the plane and, the second end having a disc retaining head; and a plurality of discs, each one of the plurality of discs having a surface defining a hole therein, the hole extending perpendicular to the plane of the opposing frame edges and the hole surrounding a portion of the length of one of the disc attachment posts and having at least one dimension smaller than a corresponding dimension of the disc retaining head.

* * * * *